US006983894B2

(12) United States Patent
Everingham

(10) Patent No.: US 6,983,894 B2
(45) Date of Patent: Jan. 10, 2006

(54) PIEZO-ELECTRICALLY ACTUATED CANISTER PURGE VALVE WITH A HYDRAULIC AMPLIFIER

(75) Inventor: Gary M. Everingham, Chatham (CA)

(73) Assignee: Siemens VDO Automotive Inc., Chatham (CA)

( * ) Notice: Subject to any disclaimer, the term of this patent is extended or adjusted under 35 U.S.C. 154(b) by 0 days.

(21) Appl. No.: 10/365,640

(22) Filed: Feb. 13, 2003

(65) Prior Publication Data

US 2003/0150432 A1 Aug. 14, 2003

Related U.S. Application Data

(60) Provisional application No. 60/356,999, filed on Feb. 13, 2002.

(51) Int. Cl.
*F02M 47/02* (2006.01)

(52) U.S. Cl. ..... 239/88; 239/585.1; 239/102.2; 123/520; 137/614.21

(58) Field of Classification Search ..... 239/88, 239/90, 91, 92, 93, 94, 95, 96, 585.1, 585.2, 239/585.3, 585.4, 585.5, 102.1, 102.2; 137/614.21; 123/520, 516
See application file for complete search history.

(56) References Cited

U.S. PATENT DOCUMENTS 3,877,226 A 4/1975 Blum ..... 60/545
3,995,813 A 12/1976 Bart et al. ..... 239/584
4,022,166 A 5/1977 Bart ..... 123/32
4,416,239 A * 11/1983 Takase et al. ..... 123/406.47
4,762,300 A * 8/1988 Inagaki et al. ..... 251/129.06
4,944,276 A * 7/1990 House et al. ..... 123/520
4,953,514 A * 9/1990 Beicht et al. ..... 123/520
4,995,587 A * 2/1991 Alexius ..... 251/129.06
5,055,733 A 10/1991 Eylman ..... 310/328
5,063,542 A 11/1991 Petermann et al. ..... 367/166
5,115,880 A 5/1992 Sallas et al. ..... 181/106
5,226,401 A 7/1993 Clarke et al. ..... 123/571
5,413,082 A * 5/1995 Cook et al. ..... 123/520
5,417,142 A 5/1995 Lohmann ..... 91/459

(Continued)

FOREIGN PATENT DOCUMENTS

JP 02190683 A * 7/1990

*Primary Examiner*—Dinh Q. Nguyen

(57) ABSTRACT

A canister purge valve, and an emission control system, for regulating a fuel vapor flow between a fuel vapor collection canister and an intake manifold of an intake manifold of an internal combustion engine. The canister purge valve includes a body having a passage extending between a first port and a second port, a seat defining a portion of the passage, a member movable with respect to the seat, and an actuator that moves the member. The first port of the body is adapted to be in fluid communication with the fuel vapor collection canister, and the second port of the body is adapted to be in fluid communication with the intake manifold of the internal combustion engine. The member moves generally along an axis between a first configuration that prohibits fuel vapor flow through the seat and a second configuration that permits fuel vapor flow through the seat. And the actuator includes a piezo-electric element that moves the member from the first configuration to the second configuration.

20 Claims, 2 Drawing Sheets

U.S. PATENT DOCUMENTS

| | | | | |
|---|---|---|---|---|
| 5,697,554 | A | 12/1997 | Auwaerter et al. | 239/88 |
| 5,779,149 | A | 7/1998 | Hayes, Jr. | 239/124 |
| 6,062,532 | A | 5/2000 | Gurich et al. | 251/57 |
| 6,168,133 | B1 | 1/2001 | Heinz et al. | 251/57 |
| 6,213,414 | B1 | 4/2001 | Stier et al. | 239/584 |
| 6,216,964 | B1 | 4/2001 | Lambert | 239/533.12 |
| 6,302,333 | B1 | 10/2001 | Hoffmann et al. | 239/88 |
| 6,371,085 | B1 | 4/2002 | Boecking | 123/498 |
| 6,631,881 | B2 * | 10/2003 | Weldon et al. | 251/129.02 |
| 6,651,953 | B2 * | 11/2003 | Weldon | 251/129.02 |
| 6,668,807 | B2 * | 12/2003 | Weldon et al. | 123/520 |
| 2002/0088492 | A1 * | 7/2002 | Weldon et al. | 137/487.5 |

* cited by examiner

A
32
30
34
48
40
70
D1
14
50
D2
24
52
26
54
28
27
60
56
25
A

PIEZO-ELECTRICALLY ACTUATED CANISTER PURGE VALVE WITH A HYDRAULIC AMPLIFIER

CROSS REFERENCE TO CO-PENDING APPLICATIONS

This application claims the benefit of the earlier filing date of U.S. Provisional Application No. 60/356,999, filed 13 Feb. 2002, the disclosure of which is incorporated by reference herein in its entirety.

FIELD OF THE INVENTION

This invention relates generally to on-board emission control systems for internal combustion engine powered motor vehicles, e.g., evaporative emission control systems, and more particularly to an emission control valve, such as a canister purge valve for an evaporative emission control system.

A known on-board evaporative emission control system includes a vapor collection canister that collects fuel vapor emitted from a tank containing volatile liquid fuel for the engine, and a canister purge solenoid (CPS) valve for periodically purging collected vapor to an intake manifold of the engine. The CPS valve in the known evaporative system control system includes an electromagnetic solenoid that is under the control of a purge control signal generated by a microprocessor-based engine management system.

The purge control signal is believed to be a duty-cycle modulated square-pulse waveform having a relatively low operating frequency, e.g., in the 5 Hz to 20 Hz range, which is modulated between 0% and 100%. This means that for each cycle of the operating frequency, the electromagnetic solenoid is energized for a certain percentage of the time period of the cycle. During the energized, i.e., "on," time of the duty cycle, an armature of the electromagnetic solenoid travels full stroke. During the de-energized, i.e., "off," time of the duty cycle, the armature is returned to its normal position, e.g., under the bias of a spring engaging the armature. As the percentage of the duty cycle increases, the "on" time during which the electromagnetic solenoid is energized also increases, and therefore so does the purge flow through the valve. Conversely, the purge flow decreases as the percentage decreases.

However, known electromagnetic solenoids that move an armature in accordance with a duty-cycle modulated square-pulse wave suffer from a number of disadvantages, including slow response time and large overall size.

SUMMARY OF THE INVENTION

The present invention provides a canister purge valve for regulating a fuel vapor flow between a fuel vapor collection canister and an intake manifold of an intake manifold of an internal combustion engine. The canister purge valve includes a body having a passage extending between a first port and a second port, a seat defining a portion of the passage, a member movable with respect to the seat, and an actuator that moves the member. The first port of the body is adapted to be in fluid communication with the fuel vapor collection canister, and the second port of the body is adapted to be in fluid communication with the intake manifold of the internal combustion engine. The member moves generally along an axis between a first configuration that prohibits fuel vapor flow through the seat and a second configuration that permits fuel vapor flow through the seat.

And the actuator includes a piezo-electric element that moves the member from the first configuration to the second configuration.

The present invention also provides an emission control system for an automobile, which has a fuel tank that supplies fuel to an internal combustion engine. The fuel tank holds a supply of volatile liquid fuel and fuel vapor in a headspace above the liquid fuel. The internal combustion engine combusts a combination of the fuel and air, which is drawn through an intake manifold of the internal combustion engine. The emission control system includes a fuel vapor collection canister and a purge valve. The fuel vapor collection canister includes a collection port and a discharge port. The collection port is in fluid communication with the headspace of the fuel tank. The purge valve includes an inlet that is in fluid communication with the discharge port of the fuel vapor, and includes an outlet that is in fluid communication with the intake manifold of the internal combustion engine. The purge valve further includes a body that has a passage that extends between the inlet and the outlet, a seat that defines a portion of the passage, a member that moves with respect to the seat, and an actuator. The member moves generally along an axis between a first configuration that prohibits fuel vapor flow through the seat and a second configuration that permits fuel vapor flow through the seat. The actuator includes a piezo-electric element that moves the member from the first configuration to the second configuration.

BRIEF DESCRIPTION OF THE DRAWINGS

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DETAILED DESCRIPTION OF THE PREFERRED EMBODIMENTS

Figure 1:
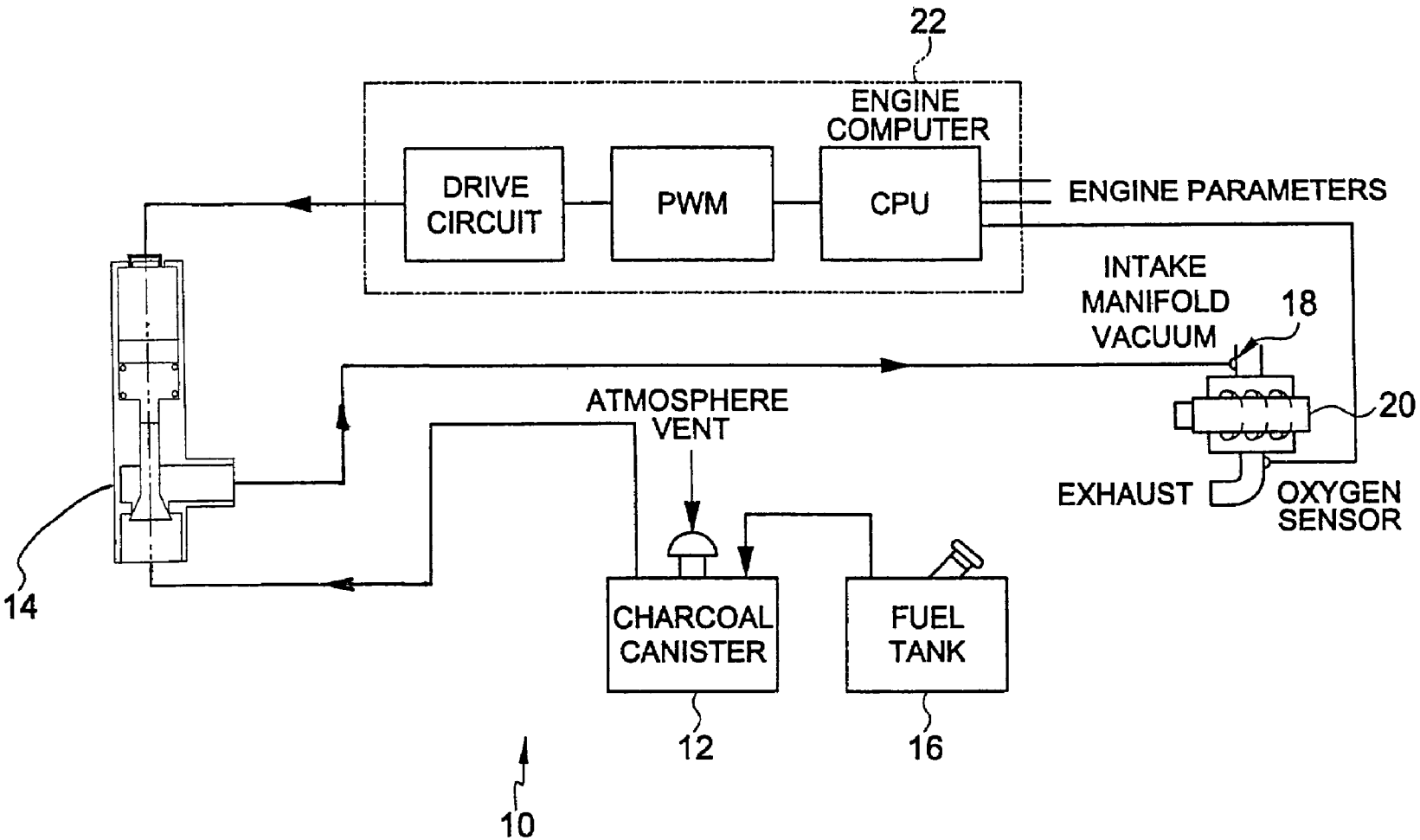
FIG. 1 is a schematic diagram of an evaporative emission control system including a canister purge valve according to a preferred embodiment.

FIG. 1 shows an evaporative emission control system 10, such as for a motor vehicle (motor vehicle not shown), that comprises a vapor collection canister 12, and a canister purge valve 14 according to the present disclosure. The valve 14 is connected in series between a fuel tank 16 and an intake manifold 18 of an internal combustion engine 20. An engine management computer 22 that receives various input signals supplies a purge control output signal for operating valve 14.

Figure 2:
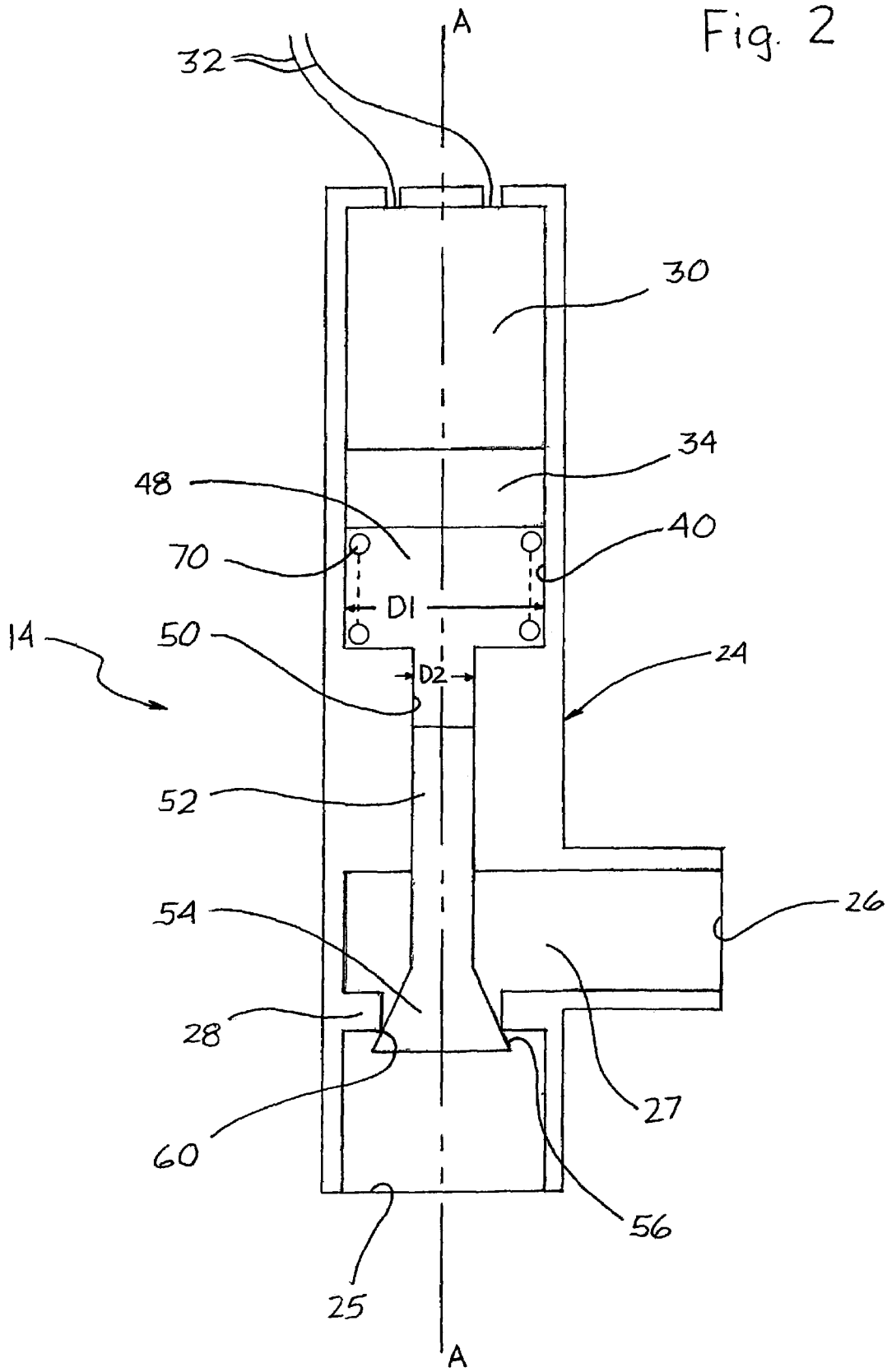
FIG. 2 is a cross-section view of a canister purge valve according to a preferred embodiment.

Referring to FIG. 2, the valve 14 comprises a body part 24 having an inlet port 25 and an outlet port 26. Body part 24 is fabricated from suitable fuel-tolerant material, such as by injection molding. The two ports 25,26 can be embodied as nipples. Body part 24 provides for the mounting of the valve 14 at a suitable mounting location on an automotive vehicle, e.g., on the vapor collection canister 12. The body part 24 includes a passage 27 extending between the inlet and outlet ports 25, 26. A seat 28 defines a portion of the passage 27.

Valve 14 further comprises a piezo-electric assembly 30 that is housed within body part 24. The piezo-electric assembly 30 can include a single piezo-electric element or can include a plurality of stacked piezo-electric elements. The piezo-electric assembly 30 is actuated in response to an electric signal provided at terminals 32 by the engine management computer 22.

Reference characters A—A designate an imaginary longitudinal axis of valve 14 with which piezo-electric assembly 30 and inlet port 25 are coaxial. The piezo-electric element(s) of the piezo-electric assembly 30 are arranged so as to expand or contract principally along the longitudinal axis A—A. Preferably, the application of an electric signal at the terminals 32 causes the piezo-electric element(s) to expand along the longitudinal axis A—A, and discontinuing the electric signal at the terminals 32 causes the piezo-electric element(s) to contract along the longitudinal axis A—A.

According to the illustrated embodiment, the piezo-electric assembly 30 contiguously engages a first piston 34. The first piston 34 is slidingly received in a first bore 40 defined by the housing 24. Preferably, the first bore 40 has an inside diameter D1.

The first bore 40 is in fluid communication with a second bore 50 defined by the housing 24. Preferably, the second bore 50 has an inside diameter D2. A second piston 52 is slidingly received in the second bore 50.

Preferably, the first and second pistons 34,52 are provided with fluid tight seals relative to the first and second bores 40,50, respectively. As such, a predetermined volume of substantially incompressible hydraulic fluid 48 is captured in the space defined by the first and second pistons 34,52 and by the first and second bores 40,50.

The second piston 52 is coupled to a pintle 54. Preferably, the second piston 52 and the pintle 54 are integrally formed from a single, homogeneous material. The pintle 54 includes a sealing face 56 that is adapted to engage the seat 28 defined by the housing 24. In a closed configuration of the canister purge valve 14, the sealing face 56 of the pintle 54 contiguously and sealingly engages a sealing edge 60 of the seat 28. The closed configuration of the canister purge valve 14 is shown in FIG. 2.

Preferably, a resilient member 70 provides a biasing force opposing the expansion force of the piezo-electric assembly 30. The resilient member 70 is preferably a compression coil spring that extends between the housing 24 and the first piston 34, and occupies a portion of the space in which the hydraulic fluid 48 is captured. Of course, other types of resilient members 70, e.g., a wave spring, and other arrangements of the resilient member 70, e.g., extending between the housing 24 and the pintle 54, are also envisioned.

The inside diameter D1 of the first bore 40 is larger than the inside diameter D2 of the second bore 50 such that a relatively small displacement along the longitudinal axis A—A of the first piston 34 by the piezo-electric assembly 30 causes a relatively large displacement along the longitudinal axis A—A of the second piston 52. Preferably, the piezo-electric assembly 30 is capable of expanding and contracting in the direction along the longitudinal axis A—A by an amount in a range of 0.01 to 0.035 millimeters. Inasmuch as the preferred range of movement of the pintle 54 along the longitudinal axis A—A is between 1.0 and 6.0 millimeters, the ratio of the inside diameters D1/D2 is at least five, and is preferably approximately 25. Of course, different relative inside diameters D1, D2 are envisioned for providing the appropriate degree of movement amplification between the displacement of the piezo-electric assembly 30 and the pintle 54.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A canister purge valve for regulating a fuel vapor flow between a fuel vapor collection canister and an intake manifold of an intake manifold of an internal combustion engine, the canister purge valve comprising:

a body having a passage extending between a first port and a second port, the first port being adapted to be in fluid communication with the fuel vapor collection canister, and the second port being adapted to be in fluid communication with the intake manifold of the internal combustion engine;

a seat defining a portion of the passage;

a member movable with respect to the seat, the member moving generally along an axis to regulate the fuel vapor flow between a first configuration prohibiting fuel vapor flow through the seat and a second configuration permitting fuel vapor flow through the seat; and an actuator moving the member from the first configuration to the second configuration, the actuator including a piezo-electric element.

2. The canister purge valve according to claim 1, further comprising:

a movement amplifier coupling the actuator to the member.

3. The canister purge valve according to claim 2, wherein the movement amplifier comprises a hydraulic amplifier.

4. The canister purge valve according to claim 3, wherein the hydraulic amplifier comprises:

a first bore in fluid communication with a second bore, the first bore having a first inside diameter, the second bore having a second inside diameter, and the first diameter being larger than the second diameter;

a first piston moving in the first bore, the first piston having a first outside diameter generally equal to the first inside diameter of the first bore, and the first piston being coupled to the actuator;

a second piston moving in the second bore, the second piston having a second outside diameter generally equal to the second inside diameter of the second bore, and the second piston being coupled to the member; and a fixed volume of substantially incompressible fluid in a space defined by the first piston, the first bore, the second bore, and the second piston.

5. The canister purge valve according to claim 4, wherein a ratio of the first diameter to the second diameter is at least five.

6. The canister purge valve according to claim 5, wherein the ratio of the first diameter to the second diameter is approximately 25.

7. The canister purge valve according to claim 1, wherein the actuator moves the member from the second configuration to the first configuration.

8. The canister purge valve according to claim 1, further comprising: a resilient member opposing the actuator moving the member from the first configuration to the second configuration.

9. The canister purge valve according to claim 8, wherein the resilient member comprises is a compression spring extending between the body and the member.

10. The canister purge valve according to claim 9, wherein the compression spring comprises at least one of a coil spring and a wave spring.

11. The canister purge valve according to claim 10, wherein the actuator comprises a plurality of stacked piezo-electric elements.

12. An emission control system for a vehicle having a fuel tank supplying fuel to an internal combustion engine, the fuel tank holding a supply of volatile liquid fuel and fuel vapor in a headspace above the liquid fuel, and the internal combustion engine combusting a combination of the fuel and air drawn through an intake manifold of the internal combustion engine, the emission control system comprising:

a fuel vapor collection canister including a collection port and a discharge port, the collection port being adapted to be in fluid communication with the headspace of the fuel tank; and a purge valve including an inlet and an outlet, the inlet being in fluid communication with the discharge port of the fuel vapor, and the outlet being adapted to be in fluid communication with the intake manifold of the internal combustion engine, the purge valve including:

a body having a passage extending between the inlet and the outlet;

a seat defining a portion of the passage;

a member movable with respect to the seat, the member moving generally along an axis to regulate the fuel vapor flow between a first configuration prohibiting fuel vapor flow through the seat and a second configuration permitting fuel vapor flow through the seat; and an actuator moving the member from the first configuration to the second configuration, the aperture including a piezo-electric element.

13. The emission control system according to claim 12, wherein the purge valve comprises:

a hydraulic movement amplifier coupling the actuator to the member, the hydraulic movement amplifier includes:

a first bore in fluid communication with a second bore, the first bore having a first inside diameter, the second bore having a second inside diameter, and the first diameter being larger than the second diameter;

a first piston moving in the first bore, the first piston having a first outside diameter generally equal to the first inside diameter of the first bore, and the first piston being coupled to the actuator;

a second piston moving in the second bore, the second piston having a second outside diameter generally equal to the second inside diameter of the second bore, and the second piston being coupled to the member; and a fixed volume of substantially incompressible fluid in a space defined by the first piston, the first bore, the second bore, and the second piston; and a compression spring extending between the body and the member, the compression spring opposing the actuator moving the member from the first configuration to the second configuration.

14. The emission control system according to claim 13, wherein a ratio of the first diameter to the second diameter is at least five.

15. The emission control system according to claim 14, wherein the ratio of the first diameter to the second diameter is approximately 25.

16. The emission control system according to claim 12, further comprising:

an electronic control unit electrically coupled to the piezo-electric element, the electronic control unit controlling the movement between the first and second configurations.

17. The emission control system according to claim 16, wherein the electronic control unit is adapted to be electronically coupled to the internal combustion engine, and the electronic control unit control controlling the movement between the first and second configurations in response to an operating condition of the internal combustion engine.

18. The canister purge valve according to claim 12, wherein the actuator comprises a plurality of stacked piezo-electric elements.

19. A canister purge valve for regulating a fuel vapor flow between a fuel vapor collection canister and an intake manifold of an internal combustion engine, the canister purge valve comprising:

a body having a passage extending between a first port and a second port, the first port being adapted to be in fluid communication with the fuel vapor collection canister, and the second port being adapted to be in fluid communication with the intake manifold of the internal combustion engine;

a seat defining a portion of the passage;

a member movable with respect to the seat, the member moving generally along an axis to regulate the fuel vapor flow between a first configuration prohibiting fuel vapor flow through the seat and a second configuration permitting fuel vapor flow through the seat; and an actuator moving the member from the first configuration to the second configuration, the actuator including;

a piezo-electric element; and a hydraulic movement amplifier including a fixed volume of substantially incompressible fluid.

20. The canister purge valve according to claim 19, wherein the fixed volume of substantially incompressible fluid is in a space defined by a first bore in fluid communication wit a second bore and by first and second pistons, the first bore being larger than the second bore, the first piston moving in the first bore and being coupled to the piezo-electric element, and the second piston moving in the second bore and being coupled to the member.

* * * * *